US010996617B2

(12) United States Patent
Chino

(10) Patent No.: US 10,996,617 B2
(45) Date of Patent: May 4, 2021

(54) DEVELOPING CARTRIDGE HAVING A COUPLING MEMBER AND A ROTATABLE LEVER WITH A CONTACT PORTION CAPABLE OF MOVING THE COUPLING MEMBER

(71) Applicant: CANON KABUSHIKI KAISHA, Tokyo (JP)

(72) Inventor: Hideto Chino, Ashigarakami-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/833,999

(22) Filed: Mar. 30, 2020

(65) Prior Publication Data

US 2020/0225614 A1 Jul. 16, 2020

Related U.S. Application Data

(62) Division of application No. 15/971,388, filed on May 4, 2018, now Pat. No. 10,642,216, which is a division (Continued)

(30) Foreign Application Priority Data

Jun. 4, 2012 (JP) ..... 2012-127145

(51) Int. Cl.
*G03G 21/16* (2006.01)
*G03G 15/01* (2006.01)
*G03G 15/08* (2006.01)

(52) U.S. Cl.
CPC ..... *G03G 21/1647* (2013.01); *G03G 15/0173* (2013.01); *G03G 15/0865* (2013.01); *G03G 21/1676* (2013.01)

(58) Field of Classification Search
None
See application file for complete search history.

(56) References Cited

U.S. PATENT DOCUMENTS 6,249,663 B1 6/2001 Alzawa et al.
6,256,467 B1 7/2001 Yokomori et al.
(Continued)

FOREIGN PATENT DOCUMENTS

JP 2010079284 4/2010

*Primary Examiner* — Victor Verbitsky
(74) *Attorney, Agent, or Firm* — Venable LLP

(57) ABSTRACT

A developing cartridge mountable to a development rotary of an electrophotographic image forming apparatus, a coupling member for transmitting a rotational force from a main assembly engaging portion to a developing roller, the coupling member being engageable and disengageable relative to the engaging portion with rotation of the rotary, the coupling member being movable among a rotational force transmitting angular position, a pre-engagement angular position in which the coupling member is inclined relative to that in the transmitting angular position to engage with the engaging portion, and a disengaging angular position for disengaging therefrom; and an inclination regulating member movable between a regulating position for positioning the coupling member to the pre-engagement position and a retracted position, the inclination regulating member being movable from the retracted position to the regulating position by being abutted by a function member of the rotary.

8 Claims, 18 Drawing Sheets

Related U.S. Application Data of application No. 15/384,441, filed on Dec. 20, 2016, now Pat. No. 9,989,915, which is a division of application No. 14/542,862, filed on Nov. 17, 2014, now Pat. No. 9,551,957, which is a division of application No. 13/908,251, filed on Jun. 3, 2013, now Pat. No. 8,923,731.

(56) References Cited

U.S. PATENT DOCUMENTS

| | | | | |
|---|---|---|---|---|
| 7,155,141 | B2 | 12/2006 | Sato et al. | |
| 8,086,135 | B2 | 12/2011 | Hashimoto | |
| 8,233,821 | B2 | 7/2012 | Miyabe et al. | |
| 8,270,876 | B2 | 9/2012 | Morioka et al. | |
| 8,391,748 | B2 | 3/2013 | Miyabe et al. | |
| 8,433,219 | B2 | 4/2013 | Miyabe et al. | |
| 8,437,669 | B2 | 5/2013 | Morioka et al. | |
| 8,494,411 | B2 | 7/2013 | Miyabe et al. | |
| 8,688,008 | B2 | 4/2014 | Norioka et al. | |
| 2008/0240796 | A1* | 10/2008 | Morioka ..... | G03G 21/186 399/279 |
| 2008/0260428 | A1 | 10/2008 | Ueno et al. | |
| 2009/0317134 | A1 | 12/2009 | Miyabe et al. | |
| 2009/0317135 | A1 | 12/2009 | Miyabe et al. | |
| 2010/0054823 | A1 | 3/2010 | Takasaka et al. | |
| 2011/0103812 | A1 | 5/2011 | Takasaka et al. | |
| 2011/0268473 | A1 | 11/2011 | Hashimoto | |
| 2011/0279938 | A1 | 11/2011 | Shimizu et al. | |
| 2011/0311254 | A1 | 12/2011 | Kawata et al. | |
| 2012/0121290 | A1 | 5/2012 | Asanuma et al. | |
| 2012/0195635 | A1 | 8/2012 | Miyabe et al. | |

* cited by examiner (a)

(b)

(b)

(a)

(b)

(a)

(b)

(a)

(b)

(a)

(b)

(a)

(b)

(a)

(b)

(a)

(b)

(a)

DEVELOPING CARTRIDGE HAVING A COUPLING MEMBER AND A ROTATABLE LEVER WITH A CONTACT PORTION CAPABLE OF MOVING THE COUPLING MEMBER

FIELD OF THE INVENTION AND RELATED ART

The present invention relates to an electrophotographic image forming apparatus and a developing cartridge usable for the electrophotographic image forming apparatus.

Conventionally, in a field of an electrophotographic image forming apparatus, a rotary member type color printer comprising a development rotary member rotatable carrying a plurality of developing cartridge is known. In order to transmit a rotational force from a main assembly of the apparatus to the developing cartridge, coupling members are provided in the main assembly of the apparatus side and the developing cartridge side, respectively so that the rotational force is transmitted to the developing cartridge when the couplings are engaged with each other. By doing so, the transmission of the rotation from the main assembly of the apparatus to the developing cartridge is smooth, as compared with the transmission using gears.

In the rotary member type color printer, for the engagement and disengagement of the coupling members, the coupling member of the main assembly of the apparatus side is operated in synchronism with the rotating operation of the development rotary member using an operation device such as a solenoid.

Japanese Laid-open Patent Application 2010-79284 discloses a developing cartridge comprising a coupling member capable of engaging with and disengaging from a driving shaft provided in the main assembly of the apparatus in a direction substantially perpendicular to an axial direction of the driving shaft, by the rotation of the development rotary member.

In order for the disengaged coupling member to engage assuredly with the driving shaft by rotation of the development rotary member, the coupling member takes a pre-engagement angular position in which the coupling member is inclined from a rotational axis at a rotational force transmitting angular position for transmitting the rotational force from the driving shaft to the coupling member, and therefore, the coupling member is inclined by an elastic force of a coil spring or the like to assuredly place it at the pre-engagement angular position.

With such a structure, the engagement and disengagement of the coupling member can be accomplished in a rotary member type color printer which is not provided with a mechanism such as a solenoid for moving the main assembly side coupling member in the axial direction thereof.

SUMMARY OF THE INVENTION

The present invention provides a developing cartridge and an image forming apparatus with which the coupling member is assuredly placed in the pre-engagement angular position without using an urging means such as the coil spring, by which production of hitting sound can be avoided when the coupling member returns to the pre-engagement angular position after disengagement from the driving shaft.

According to an aspect of the present invention, there is provided a developing cartridge detachably mountable to a development rotary member of an electrophotographic image forming apparatus, the electrophotographic image forming apparatus including a rotatable main assembly engaging portion, a rotatable development rotary member, and a function member, said developing cartridge comprising a developing roller configured to develop a latent image formed on an image bearing member; a developer accommodating portion configured to accommodate a developer for developing the latent image using said developing roller; a coupling member configured to transmit a rotational force from the main assembly engaging portion to said developing roller, said coupling member being engageable with and disengageable from the main assembly engaging portion with rotation of the development rotary member, said coupling member being movable among a rotational force transmitting angular position for transmitting the rotational force to said developing roller through the engagement with the main assembly engaging portion, a pre-engagement angular position in which a rotational axis of said coupling member is inclined relative to that in the rotational force transmitting angular position to be brought into engagement with the main assembly engaging portion and a disengaging angular position for disengaging from the main assembly engaging portion; and an inclination regulating member movable between a regulating position for positioning said coupling member to the pre-engagement angular position and a retracted position retracted from the regulating position, said inclination regulating member being movable from the retracted position to the regulating position by being abutted by the function member with rotation of the development rotary member.

According to another aspect of the present invention, there is provided an electrophotographic image forming apparatus for forming an image on a recording material, said electrophotographic image forming apparatus comprising a rotatable main assembly engaging portion; a rotatable development rotary member; a function member; and a developing cartridge detachably mountable to said development rotary member, said developing cartridge including, a developing roller configured to develop a latent image formed on an image bearing member, a developer accommodating portion configured to accommodate a developer for developing the latent image using said developing roller; a coupling member configured to transmit a rotational force from the main assembly engaging portion to said developing roller, said coupling member being engageable with and disengageable from the main assembly engaging portion with rotation of the development rotary member, said coupling member being movable among a rotational force transmitting angular position for transmitting the rotational force to said developing roller through the engagement with the main assembly engaging portion, a pre-engagement angular position in which a rotational axis of said coupling member is inclined relative to that in the rotational force transmitting angular position to be brought into engagement with the main assembly engaging portion and a disengaging angular position for disengaging from the main assembly engaging portion, and an inclination regulating member movable between a regulating position for positioning said coupling member to the pre-engagement angular position and a retracted position retracted from the regulating position, said inclination regulating member being movable from the retracted position to the regulating position by being abutted by the function member with rotation of the development rotary member.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

The developing cartridge and the electrophotographic image forming apparatus according to an embodiment of the present invention will be described. The present invention relates to a developing cartridge per se and an electrophotographic image forming apparatus per se.

Figure 5:
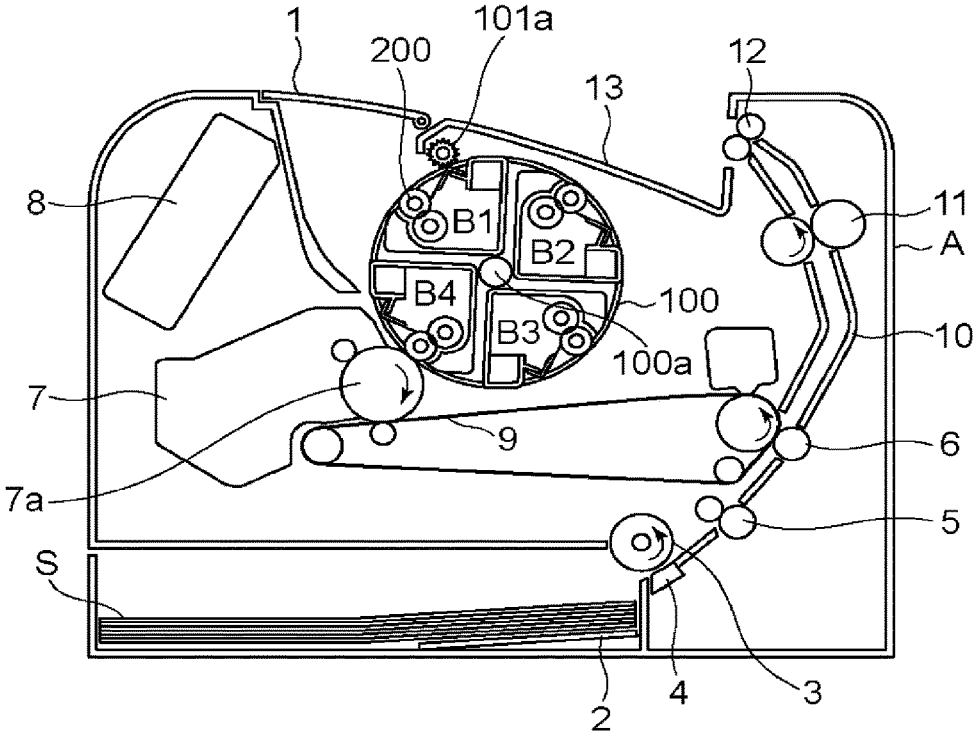
FIG. 5 is a perspective view of the developing cartridge according to the first embodiment.
Figure 6:
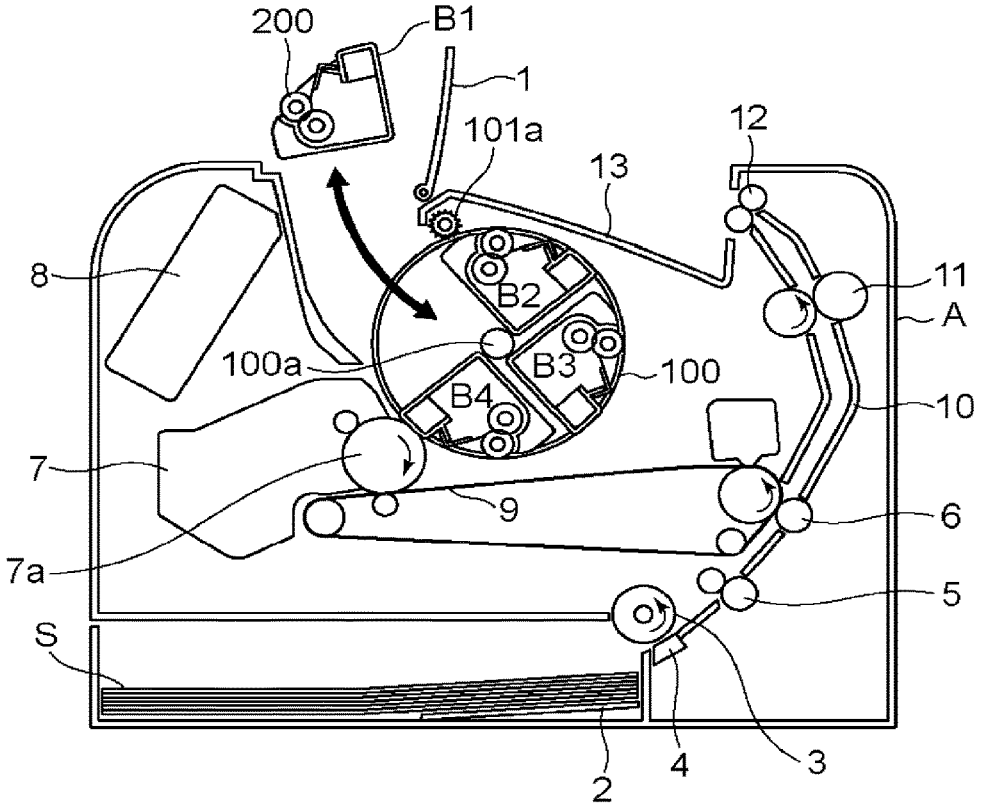
FIG. 6 is a schematic sectional view of the developing cartridge according to the first embodiment.

Embodiment 1:

(1) Electrophotographic Image Forming Apparatus:

Referring to FIG. 5 and FIG. 6, the description will be made as to a main assembly of the color electrophotographic image forming apparatus using a developing cartridge according to an embodiment of the present invention. FIG. 5 is a schematic sectional view of the main assembly. FIG. 6 is a schematic illustration of mounting of a developing cartridge B to the main assembly.

Here, the main assembly is the structure of the apparatus not including the developing cartridge B. The main assembly of this embodiment is a so-called rotary member type color printer.

As shown in FIG. 5 the main assembly includes a development rotary member 100 rotatable about a rotary member shaft bearing 100*a* by a rotary member gear 101*a*. Four developing cartridges B1, B2, B3, B4 accommodating different color developers (toner) are detachably mountable to the rotary member 100. As shown in FIG. 6, the developing cartridge B1 is mounted to and dismounted from the rotary member 100 by the user of the main assembly, while opening and closing the cartridge cover 1. The other developing cartridges B2, B3, B4 can also be mounted to or dismounted from the rotary member 100, while sequentially rotating the rotary member 100.

The main assembly is provided with sheet materials S for recording the toner image and a stacking portion 2 for stacking the sheet materials S, and when the stacking portion 2 is raised, the topmost portion of the sheet materials S abuts to feeding roller 3. The sheet material S is fed by rotation of the feeding roller 3 in the counterclockwise direction one by one with the aid of a separation pad 4. The separated sheet material S is fed to a secondary transfer roller 6 as second transferring means through a pair of registration rollers.

An image data is formed on a photosensitive drum 7*a* as an image bearing member of a photosensitive member unit 7 by an unshown electric circuit, and an electrostatic latent image is formed accordingly on the photosensitive drum 7*a* by an exposing unit 8. The rotary member 100 rotates by the rotation of the rotary member gear 101*a* to face the developing cartridges B1, B2, B3, B4 to the photosensitive drum 7*a*. The electrostatic latent image formed on the photosensitive drum 7*a* is developed with the developer carried on the developing roller 200 of the developing cartridge into a toner image.

The developed toner image is primary-transferred onto an intermediary transfer belt 9. By carrying out such a developing operation for each color the color toner image is formed on the intermediary transfer belt 9. Is toner image is then transferred from the intermediary transfer belt 9 onto the sheet material S by a secondary transfer roller 6. Thereafter, the sheet is fed to a fixing device including a pair of fixing rollers where the toner image is fixed by being heated and pressed, and thereafter, the sheet is discharged to the outside of the main assembly by the pair of discharging rollers 12 and is stacked on a discharging and stacking portion 13. By doing so, the formation of the toner image on the sheet material S is completed.

Figure 1:
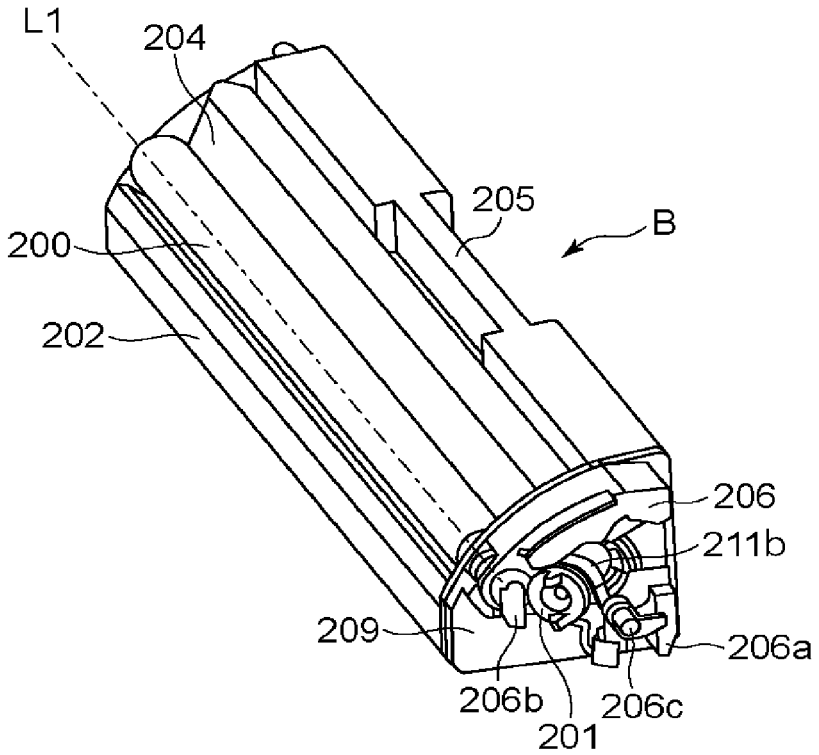
FIG. 1 is a schematic sectional view of a main assembly of the apparatus according to a first embodiment of the present invention.
Figure 2:
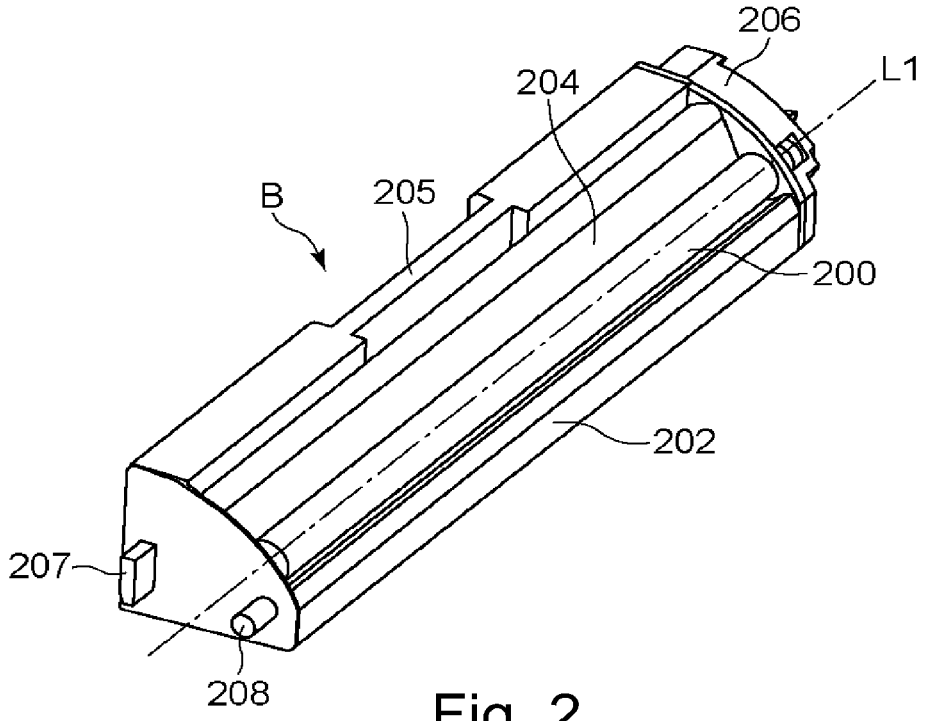
FIG. 2 is a schematic illustration of mounting of a developing cartridge to the main assembly of the apparatus according to the first embodiment.
Figure 3:
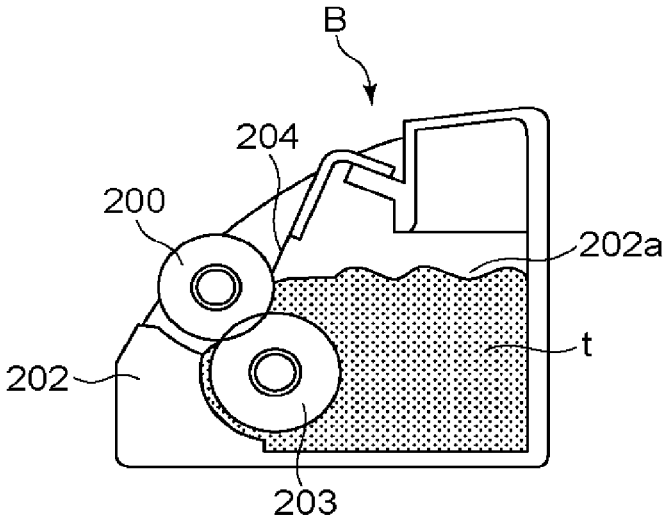
FIG. 3 is a perspective view of the developing cartridge according to the first embodiment.
Figure 4:
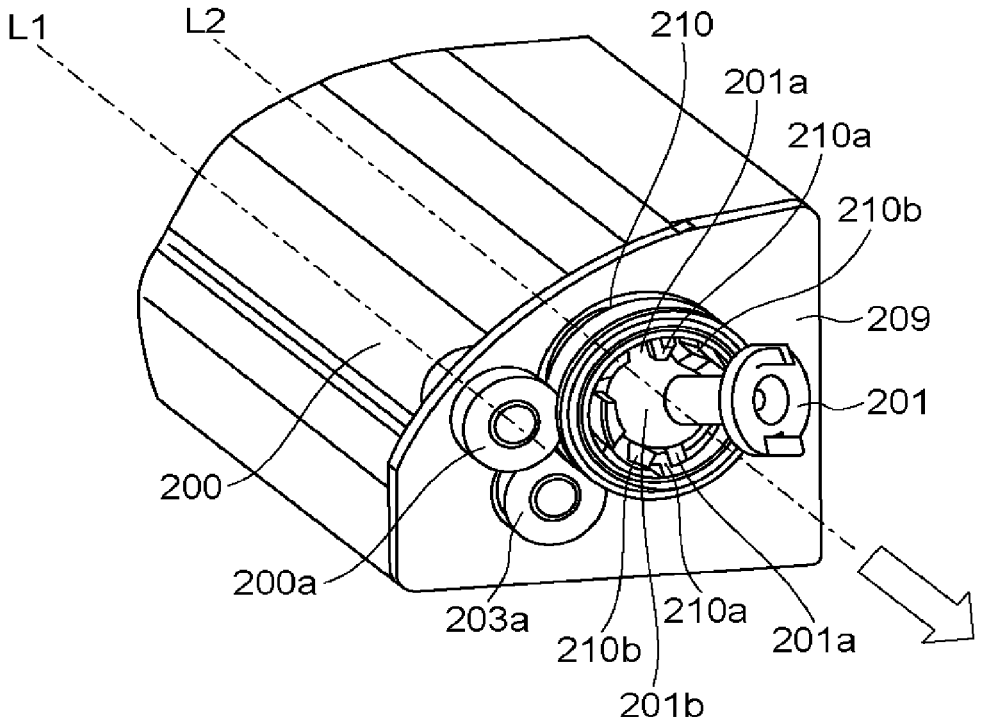
FIG. 4 is a perspective view of a driver of the developing cartridge according to the first embodiment.

(2) Developing Cartridge:

Referring to FIGS. 1, 2, 3 and 4, the developing cartridge according to the embodiment of the present invention will be described. FIG. 1 and FIG. 2 are perspective views of the developing cartridge. FIG. 3 is a schematic sectional view of the developing cartridge. FIG. 4 shows a perspective view of a driver of the developing cartridge in which a developing drive cover which will be described hereinafter is removed.

As shown in FIG. 1, the developing cartridge B includes a coupling member 201 (coupling) which is a rotational force transmitting part for receiving a rotational force from the main assembly, and a developing roller 200 for developing the electrostatic latent image on the photosensitive drum 7*a*. The developing roller 200 rotates, in the developing operation, about a rotational axis L1 by a coupling 201 receiving the rotational force from a driving shaft of the main assembly which will be described hereinafter.

As shown in FIG. 3, a developer accommodating portion 202*a* of a frame 202 contains a predetermined color developer t, which is supplied to the surface of the developing roller 200 by rotation of a supplying sponge roller 203. The developer t is supplied triboelectrically with electric and formed into a thin layer by friction between the developing roller 200 and a thin developing blade 204.

The thin layer developer on the peripheral surface of the developing roller 200 is fed to a developing position by rotation of the developing roller 200. By applying a predetermined developing bias voltage to the developing roller 200, the developing roller 200 develops the electrostatic latent image formed on the photosensitive drum 7*a*.

As shown in FIG. 1 and FIG. 2, the developing cartridge B is provided with a grip portion 205 which is used when it is mounted to and dismounted from the main assembly of the apparatus, and is mounted in the predetermined position of the rotary member 100 by positioning portions 206*a*, 206*b*, 207, 208.

A drive transmission of the developing cartridge B will be described. As shown in FIG. 4, the developing cartridge B comprises a developing unit 209 including the frame pair 202, the developing roller 200, the supplying roller 203, the developing blade 204 and so on as a unit.

The developing unit 209 includes a drive input gear 210 at the position for engagement with a developing roller gear 200*a* for rotating the developing roller 200, and a rotatable supplying roller gear 203*a* for rotating the supplying roller 203. Here, the drive input gear 210 is rotatable about a rotational axis L2.

To the drive input gear 210, the coupling 201 is mounted so as to be inclinable relative to the rotational axis L2 of the drive input gear. Inside the drive input gear 210, there is provided a driver 201*b* for the coupling which will be described hereinafter is accommodated. The drive input gear 210 is provided with a pin engaging portion 210*a* which is engaged with a drive pin 201*a* of the coupling to receive the rotational force, as will be described hereinafter. The coupling 201 is limited in the movement in the direction indicated by the arrow in the Figure by a retaining portion 210*b* provided on the drive input gear 210.

With such a structure, when the coupling 201 rotates, the developing roller gear 200*a* and the supplying roller gear 203*a* are rotated through the drive input gear 210. By this, the developing roller 200 and the supplying roller 203 are rotated. The rotational axis L2 of the drive input gear 210 and the rotational axis L1 of the developing roller 200 are parallel with each other.

Figure 7:
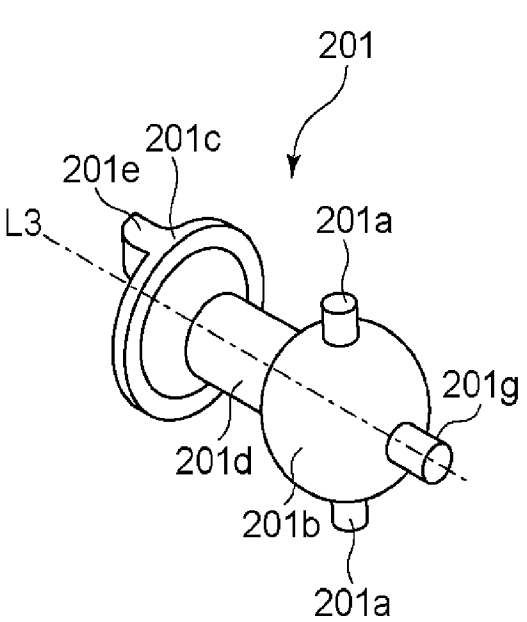
FIG. 7 is a perspective view of a coupling according to the first embodiment.
Figure 7:
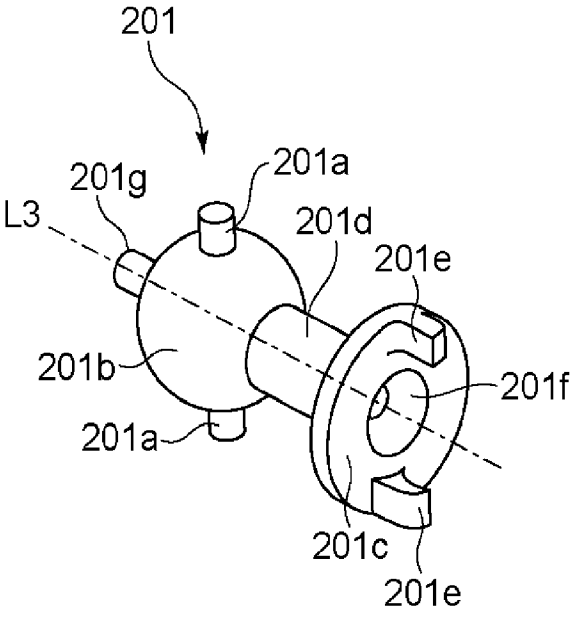
Figure 8:
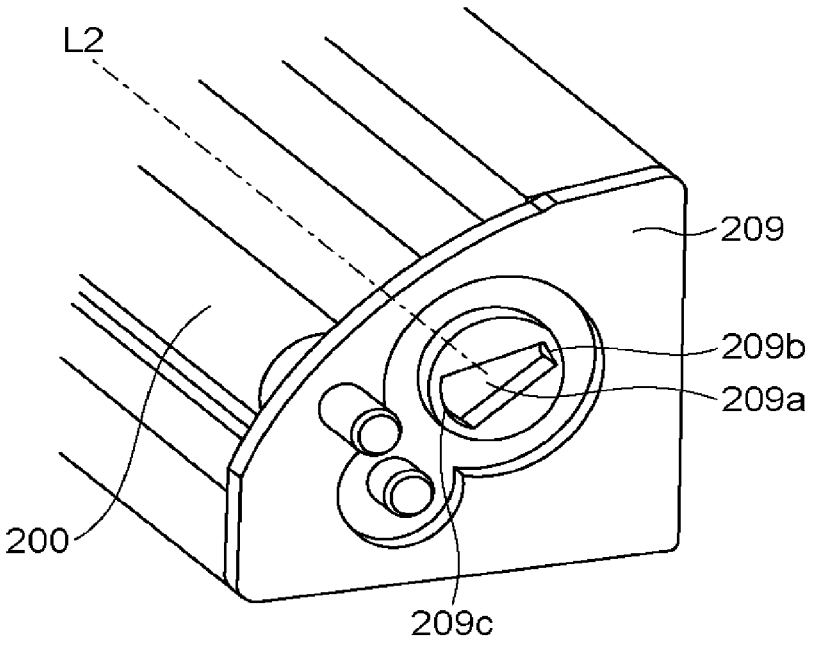
FIG. 8 is a perspective view of the developing unit according to the first embodiment.
Figure 9:
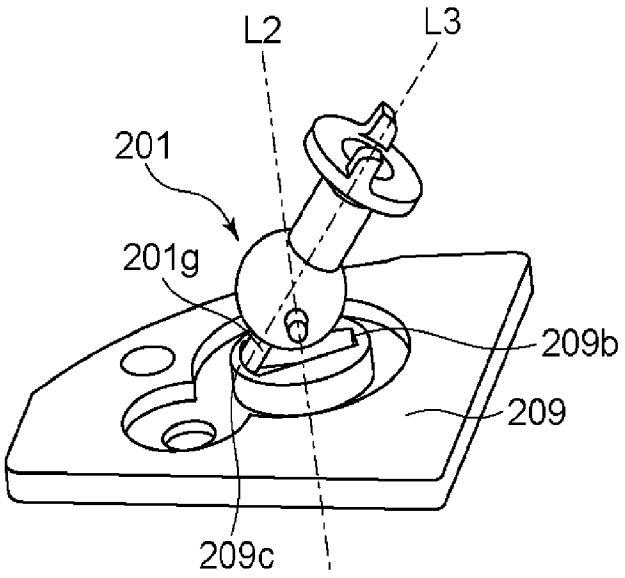
FIG. 9 is a perspective view in which an inclination of a coupling is limited, in the first embodiment.
Figure 9:
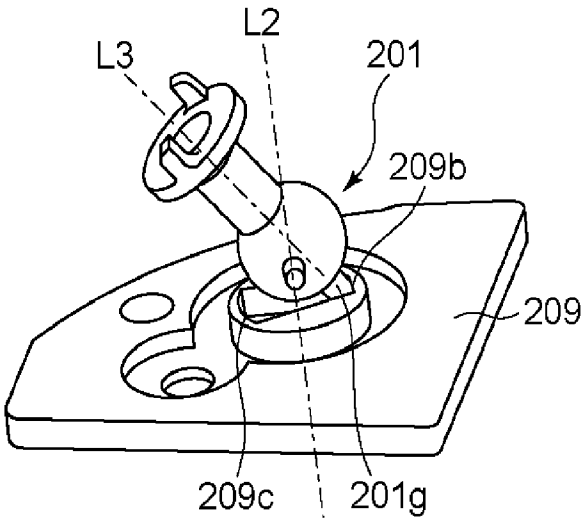

(3) Coupling:

Referring to FIG. 7 and FIGS. 8, 9, the description will be made as to the coupling 201 which is the rotational force transmitting portion for transmitting the rotational force from the driving shaft of the main assembly to the developing cartridge B. Part (a) of FIG. 7 is a perspective view of the coupling as seen from the side receiving the rotational force, and part (b) of FIG. 7 is a perspective view of the coupling as seen from the developing roller 200 side. FIG. 8 is a perspective view of the developing unit as seen from the side where the coupling is mounted. In the perspective views of part (a) and (b) of FIG. 9, the inclination of the coupling relative to the rotational axis L2 of the drive input gear is limited.

As shown in part (a) of FIG. 7 and part (b) of FIG. 7, the coupling 201 includes a driven portion 201*c* for receiving the rotational force from the driving shaft of the main assembly, the driver 201*b*, accommodated in the drive input gear 210, for transmitting the rotational force, and a connecting portion 201*d* connecting the driven portion 201*c* and the driver 201*b* with each other. The coupling 201 is rotatable about a rotational axis L3.

The driven portion 201*c* is provided with a projection 201*e* which is engaged with the driving shaft of the main assembly to receive the rotational force from the driving shaft. The driven portion 201*c* is provided with a driving shaft receiving surface 201*f* having a conical recessed configuration which expands and opens toward the driving shaft side.

The above-described driver 201*b* is substantially spherical. The driver 201*b* is accommodated inside the drive input gear 210 in the manner that it is inclinable substantially in all directions relative to the rotational axis L2 of the drive input gear 210. The driver 201*b* is provided with a drive pin 201*a* and a regulation pin 201*g*.

The drive pin 201*a* is engaged with the pin engaging portion 210*a* of the drive input gear 210 to transmit the rotational force from the coupling to the drive input gear 210. The regulation pin 201 *g* is substantially coaxial with the rotational axis L3 of the coupling 201.

As shown in FIG. 8, a developing unit 209 side as the bearing member to which the drive input gear 210 is mounted, is provided with a regulation accommodating portion 209*a*. In the side of the developing unit 209, when the drive input gear 210 and the coupling 201 are mounted to the developing unit 209, the regulation pin 201 *g* of the coupling 201 is accommodated in the regulation accommodating portion 209*a*. The regulation accommodating portion 209*a* has an end portion 209*b* and an opposite end portion 209*c*.

As shown in part (a) and part (b) of FIG. 9, the regulation pin 201 *g* is engaged with the end portion 209*b* or the end portion 209*c*, by which the inclining direction of the coupling 201 is regulated. In other words, the regulation pin 201 *g* is capable of regulating the inclining direction of the coupling 201 relative to the rotational axis L2.

Figure 10:
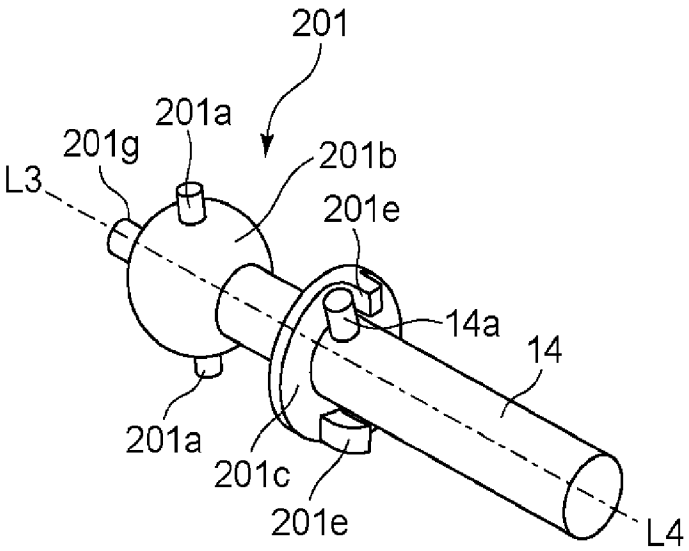
FIG. 10 is a perspective view of a driving shaft of the main assembly of the apparatus according to the first embodiment.
Figure 10:
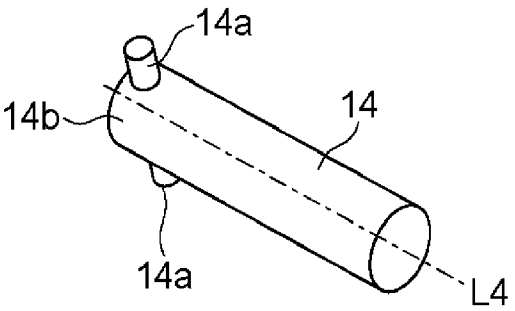

(4) Driving Shaft:

Referring to FIG. 10, the driving shaft (main assembly side engaging portion) of the main assembly will be described. Part (a) of FIG. 10 is a perspective view of the driving shaft. Part (b) of FIG. 10 is a perspective view in which the coupling 201 is engaged with the driving shaft.

As shown in part (a) of FIG. 10, the driving shaft 14 is provided with a plurality (two in this embodiment) of pin portions 14*a* (rotational force applying portions), and is rotated about a rotational axis L4 by a motor (unshown) provided in the main assembly of the apparatus. The driving shaft 14 on the rotational axis L4 adjacent the pin portion 14*a* has a semi-spherical free end portion 14*b*.

As shown in part (b) of FIG. 10, when the driving shaft 14 is opposed to the driven portion 201*c* of the coupling 201, the pin portion 14*a* and the projection 201*e* are engaged with each other. By doing so, the coupling 201 receives the rotational force from the driving shaft 14 to rotate.

Figure 11:
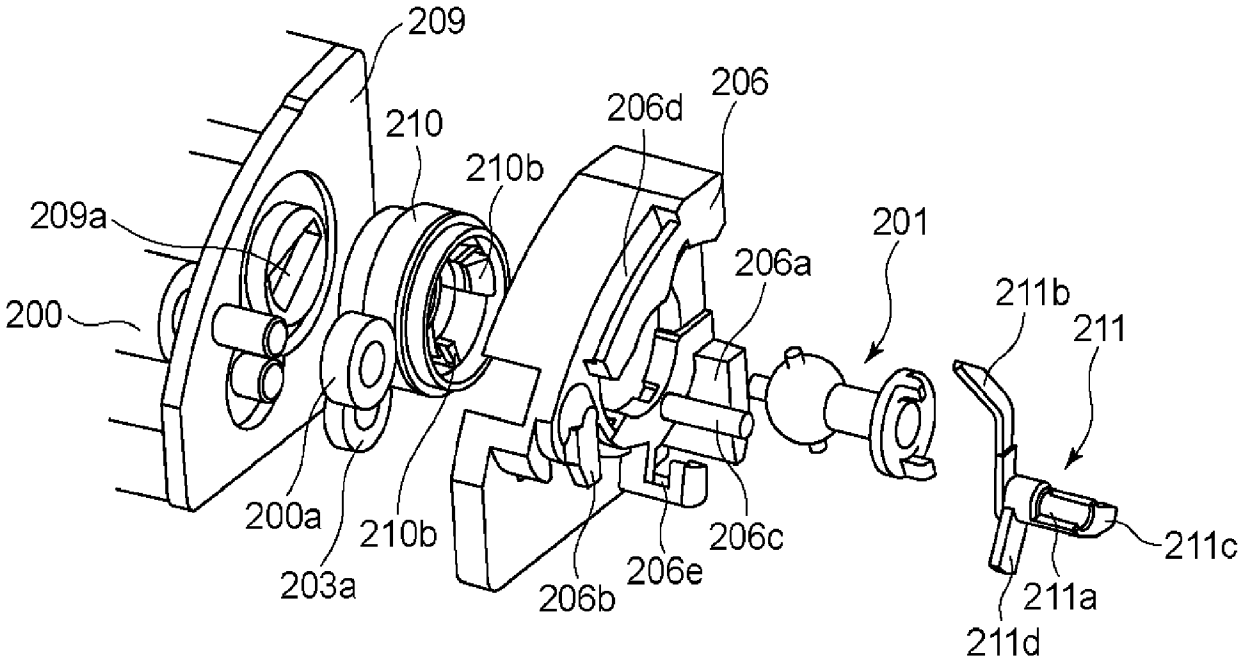
FIG. 11 is a perspective view of the developing unit before a developing drive cover is mounted to the developing unit in the first embodiment.
Figure 12:
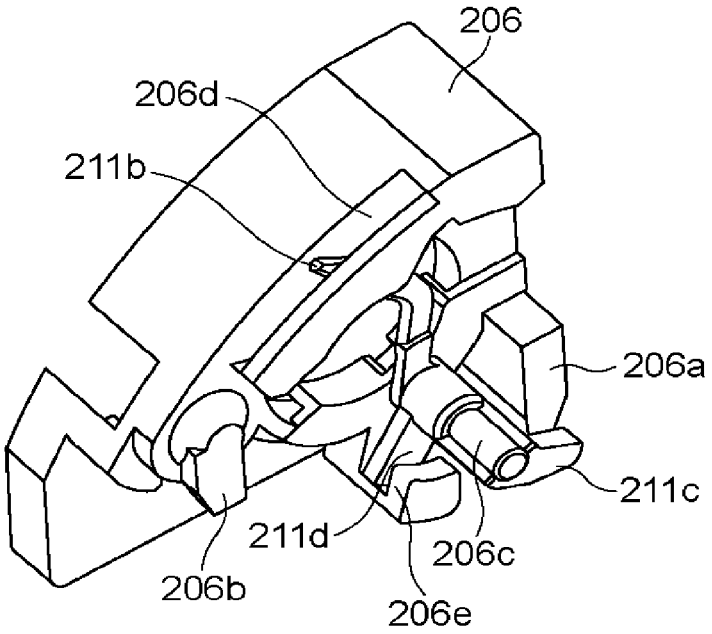
FIG. 12 is a perspective view of the developing drive cover to which an inclination regulating member is mounted, according to the first embodiment.
Figure 13:
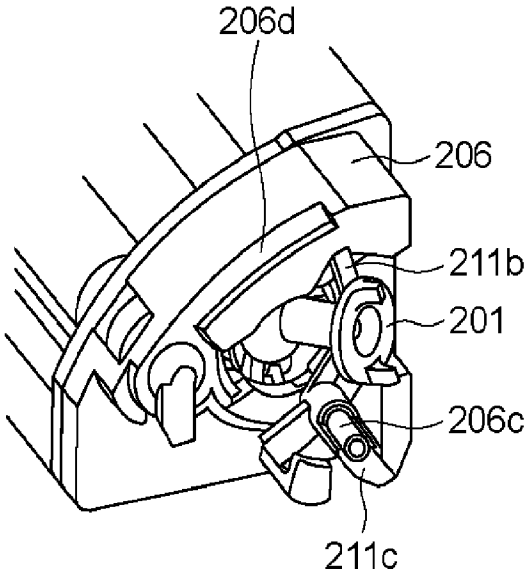
FIG. 13 is a perspective view of the developing cartridge illustrating a relation between the inclination regulating member and the coupling in the inclining direction in the first embodiment.
Figure 13:
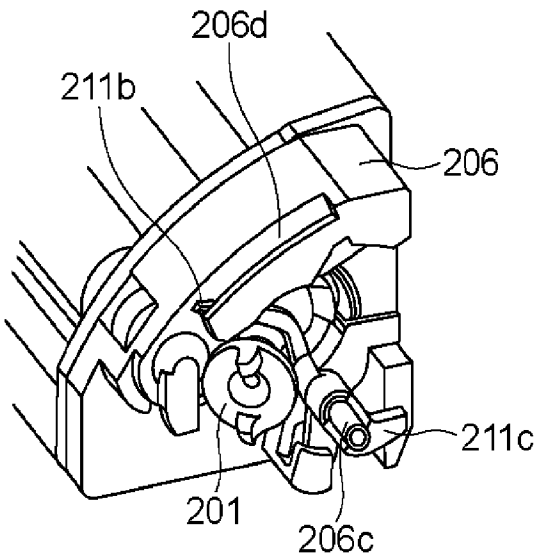

(5) Inclination Regulating Member:

Referring to FIG. 11 and FIGS. 12, 13, 8 and 9, the inclination regulating member for changing an inclining direction of the coupling in developing cartridge B will be described. FIG. 11 is a perspective view of the developing unit 209 before the coupling 201, the inclination regulating member 211 and the developing drive cover 206 are mounted thereto. FIG. 12 is a perspective view in which the inclination regulating member 211 is mounted to the developing drive cover 206. FIG. 13 is a perspective view of the developing cartridge B illustrating a relation of the inclining directions of the inclination regulating member 211 and the coupling 201.

As shown in FIG. 11, the developing drive cover 206 for protecting the driver is mounted to the developing unit 209. The developing drive cover 206 comprises the positioning portions 206*a*, 206*b*, a rotation supporting shaft 206*c*, a groove portion 206*d* and a retaining portion 206*e*.

The inclination regulating member 211 comprises a bearing portion 211*a*, an arcuate coupling contact portion 211*b*, an inclining member 211*c* and a plate portion 211*d*. The bearing portion 211*a* is mounted to the rotation supporting shaft 206*c* of the developing drive cover 206, and the coupling contact portion 211*b* is mounted to the groove portion 206*d* of the developing drive cover 206. The plate portion 211*d* is mounted to the retaining portion 206*e*, to prevent the inclination regulating member 211 from disengaging from the developing drive cover 206.

As shown in FIG. 12, the inclination regulating member 211 is rotatable about the rotation supporting shaft 206*c*. When the inclination regulating member 211 rotates, a free end portion of the coupling contact portion 211*b* rotates along the groove portion 206*d* of the developing drive cover 206 while being limited by the groove width 206*d* in the tilting. The inclining member 211*c* is contacted by the inclining member actuator of the supporting member supporting the rotary member 100 which will be described hereinafter by the rotating operation of the rotary member 100 to rotate the inclination regulating member 211.

Part (b) of FIG. 13 shows the state in which the free end portion of the coupling contact portion 211*b* is close to a right-hand end portion of the groove portion 206*d* of the developing drive cover 206 (the position of the inclination regulating member 211 is a retracted position). In this state, the coupling contact portion 211*b* does not incline the coupling 201, and the rotational axis L3 of the coupling 210 can freely incline relative to the rotational axis L2 of the drive input gear 210 within an engagement range of the regulation pin 201 *g* shown in (a) of FIG. 9 (*b*) of FIG. 9 in the regulation accommodating portion 209*a* of FIG. 8.

Part (a) of FIG. 13 shows the behavior when the free end portion of the coupling contact portion 211*b* rotationally approaches to the left-hand end portion of the groove portion 206*d* of the developing drive cover 206. When the inclination regulating member 211 moves from the position shown in part (b) to the position shown in part (a) of FIG. 13, the arcuate coupling contact portion 211*b* guides the connecting portion 201*d* of the coupling 201. The coupling contact portion 211*b* inclines the rotational axis L3 of the coupling 210 to the left in the Figure, while contacting the connecting portion 201*d*. The coupling 210 in part (a) of FIG. 13 corresponds to the state of the part (a) of FIG. 9. In this case, the inclination is possible until the regulation pin 201 *g* is brought into abutment to the end portion 209*b* of the regulation accommodating portion (the position of the inclination regulating member 211 at this time is a regulating position).

By the inclination regulating member 211 rotating in this manner, it abuts to the coupling 210 to incline the rotational axis L3 of the coupling 210 relative to the rotational axis L2 of the development input gear and change the position of the coupling.

As shown in part (a) of FIG. 9, when the inclination regulating member 211 inclines the coupling 210 until the regulation pin 201 *g* is engaged to the end portion 209*b* of the regulation accommodating portion, the coupling 210 is in a pre-engagement angular position (the position shown in part (a) of FIG. 13).

Figure 14:
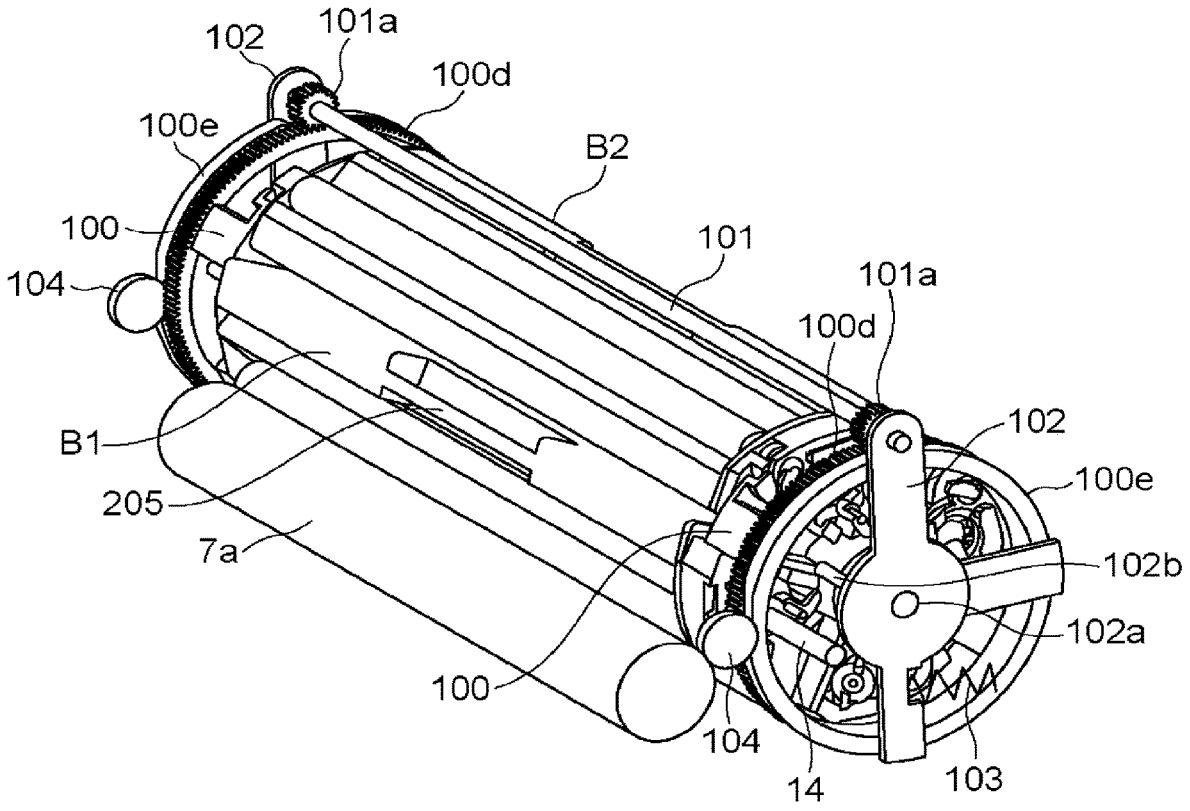
FIG. 14 is a perspective view of a rotary member as seen from the driving shaft side in the first embodiment.
Figure 15:
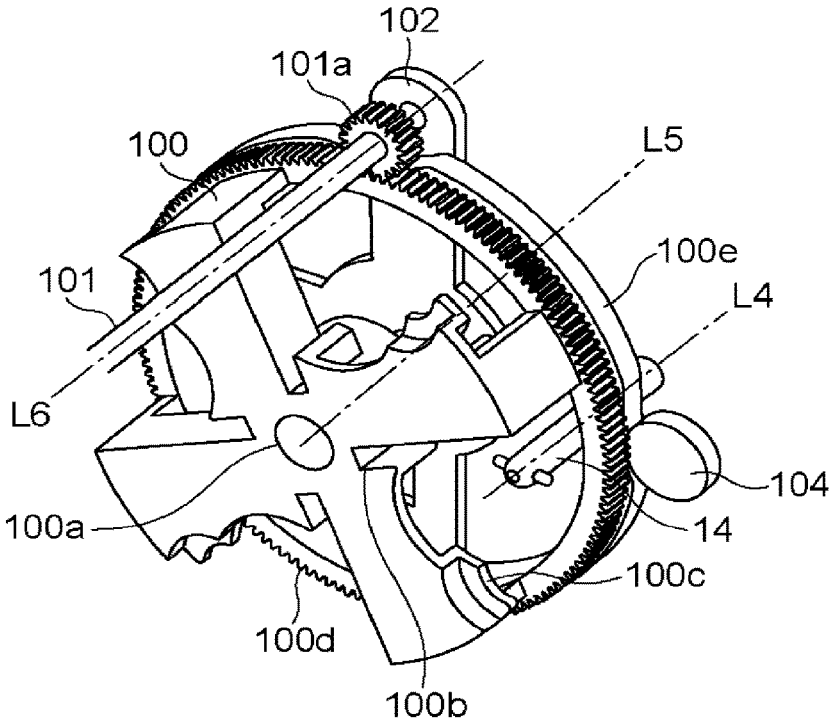
FIG. 15 is a perspective view of the rotary member as seen the developing roller side in the first embodiment.
Figure 16:
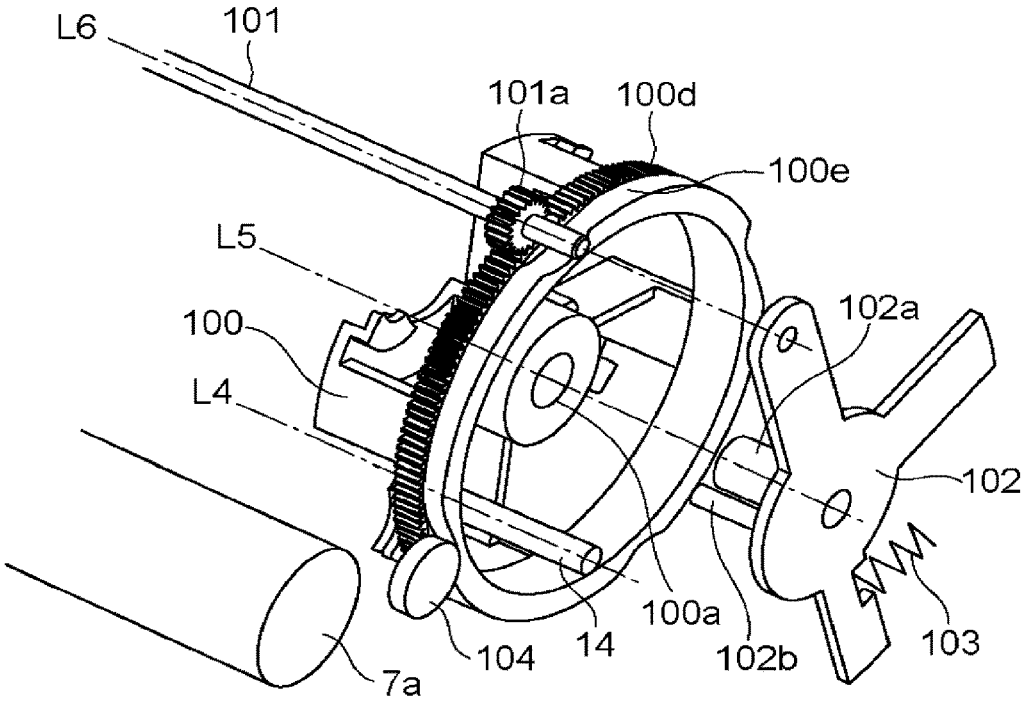
FIG. 16 is a perspective view of the rotary member as seen from the driving shaft side before a supporting member is mounted.
Figure 18:
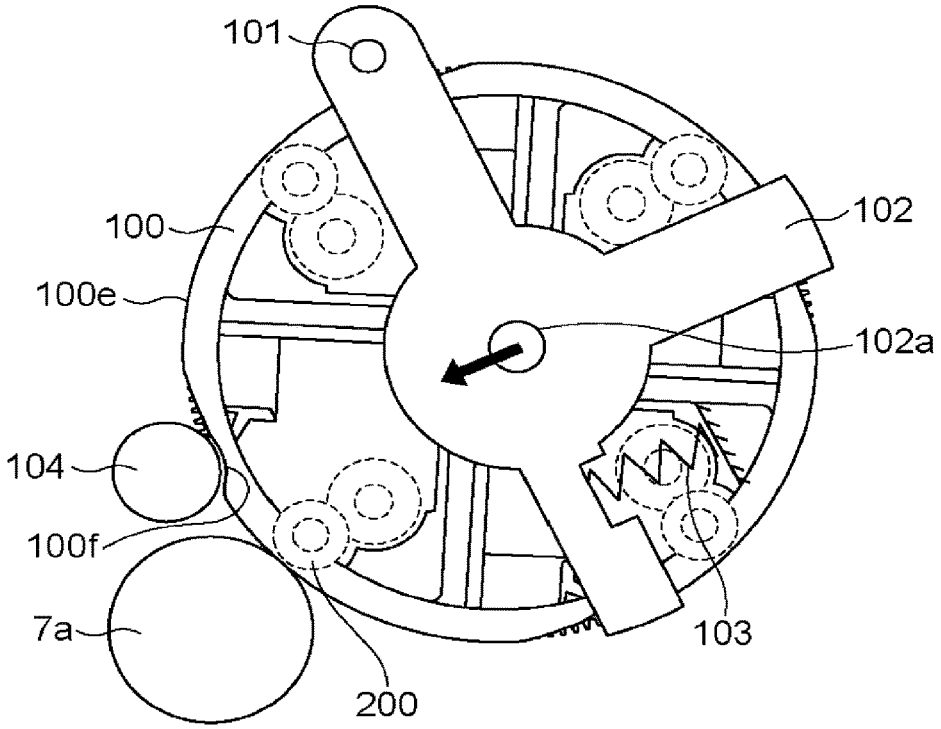
FIG. 18 is an illustration of the operation of the rotary member for switching the developing cartridge in first embodiment.
Figure 19:
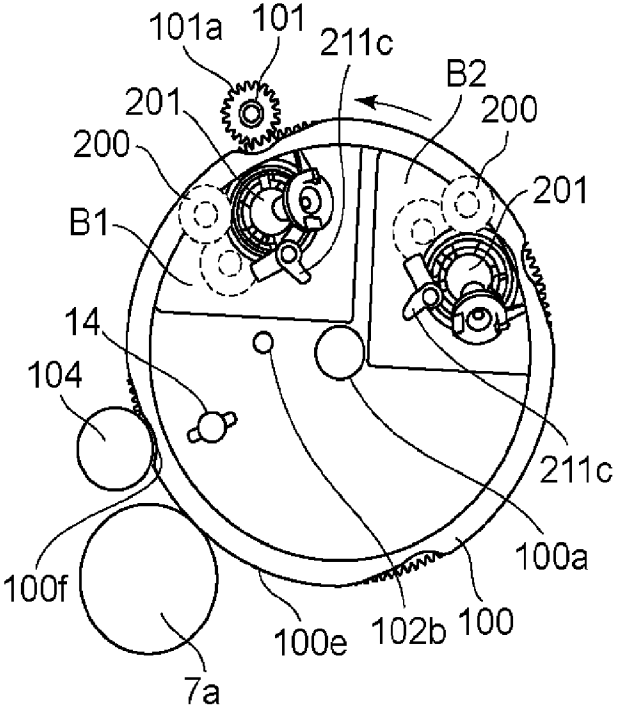
FIG. 19 is an illustration of the operation of an inclination regulating member of the developing cartridge an inclining member actuator of the rotary member supporting member, according to the first embodiment.
Figure 19:
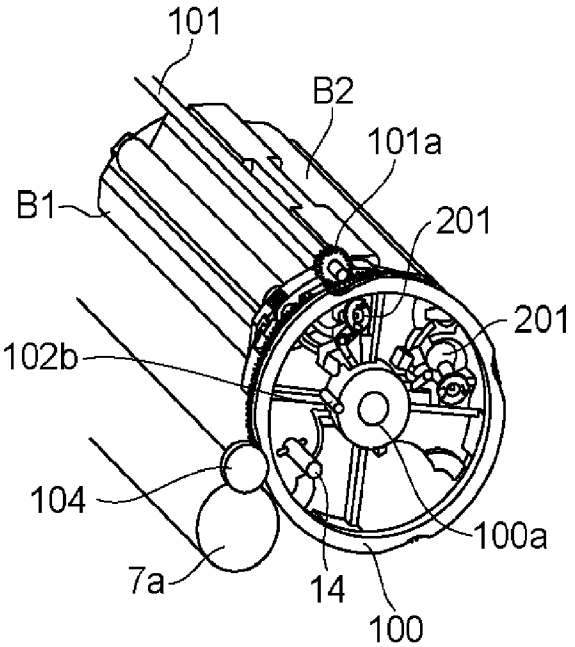

(6) Rotary Member:

rotary member 100 of the main assembly will be described. FIG. 14 is a perspective view of the rotary member 100 as seen from the driving shaft 14 side of the main assembly in which the developing cartridge B has been mounted thereto. FIG. 15 is a perspective view of the rotary member 100 as seen from the developing roller side, and FIG. 16 is a perspective view of the rotary member 100 before the supporting member is mounted thereto, as seen from the driving shaft 14 side. FIGS. 18, 19 is an illustration of operation of switching the developing cartridge B at the time when the rotary member 100 rotates.

As shown in FIG. 14, the rotary member 100 for carrying the developing cartridge B includes an unshown fixing member at each of the opposite ends of the developing cartridge B to fix the developing cartridge B.

As shown in FIG. 15, the rotary member 100 includes a plurality of mounting portions 100*b*, 100*c*, and when the developing cartridge B Is mounted to the rotary member 100, it is positioned by the positioning portions 206*a*, 206*b*, 207, 208.

The rotary member shaft 101 provided in the main assembly comprises the rotary member gear 101*a*. When the rotary member shaft 101 is rotated by the motor (unshown) provided in the main assembly of the apparatus, the rotary member gear 101*a* rotates.

As shown in FIG. 16, the bearing portion 100*a* of the rotary member 100 is rotatably supported by a rotation supporting shaft 102*a* of the supporting member 102. The supporting member 102 is rotatably supported by the rotary member shaft 101, and urges the rotary member 100 toward the photosensitive drum 7*a* by the urging spring 103. The supporting member 102 is provided with the cylindrical inclining member actuator (function member) 102*b* for operating the inclining member 211*c* of the inclination regulating member 211 of the developing cartridge.

The rotary member 100 includes a gear portion 100*d* at the outer periphery portion, and when the rotary member gear 101*a* is rotated by engagement between the gear portion 100*d* and the rotary member gear 101*a*, the rotary member 100 rotates about the bearing portion 100*a* (rotational axis L5).

Inside the rotary member 100, the driving shaft 14 of the main assembly is disposed to transmit the rotational force to the developing cartridge B with the rotational operation of the rotary member 100. The rotational force transmission to the developing cartridge B will be described hereinafter.

Figure 17:
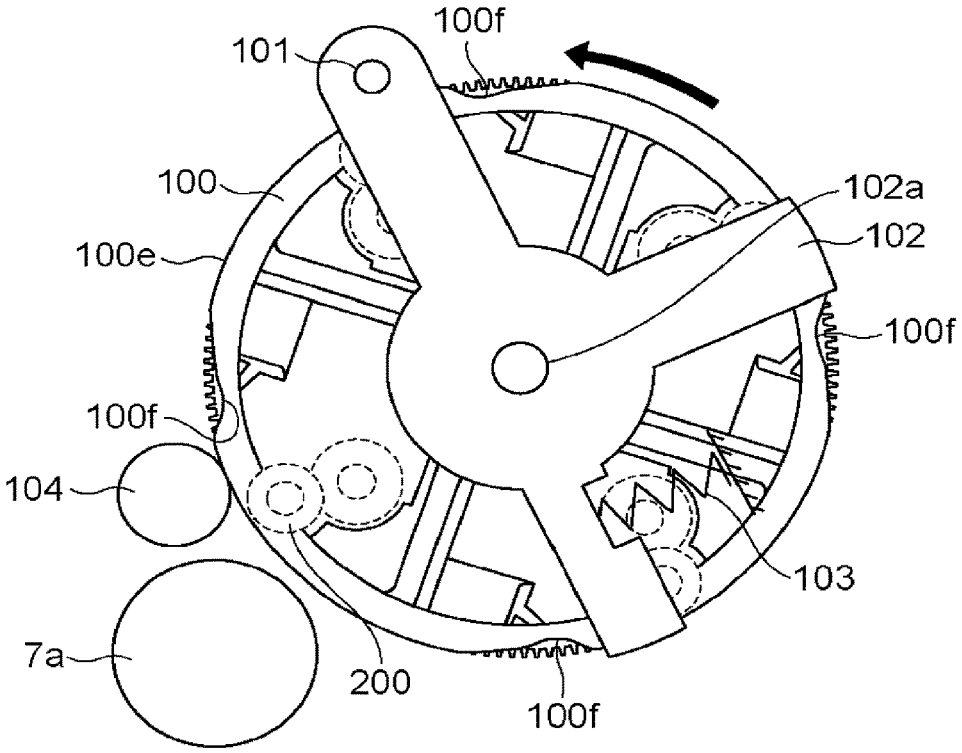
FIG. 17 is an illustration of the operation of the rotary member for switching the developing cartridge in first embodiment.

As shown in FIG. 17, the outer periphery of the rotary member is provided with a cam surface 100*e* and a plurality of recesses 100*f*, and the supporting member 102 is urged by the urging spring 103 toward the photosensitive drum 7*a*. By this, the cam surface 100*e* is abutted to a rotatable roller 104 of the main assembly. When the roller 104 contacts to the cam surface 100*e*, the rotary member 100 rotates while spacing the developing cartridge A from the photosensitive drum 7*a*.

Then, the rotary member 100 is rotated in the counter-clockwise direction (direction indicated by the arrow in the Figure) about the rotation supporting shaft 102*a* until the roller 104 is placed in the recess 100*f*, as shown in FIG. 18. At this time, the rotary member 100 swings to the left as indicated by an arrow in the Figure about the rotary member shaft 101 by the urging spring 103 by which the developing roller 200 contacts to the photosensitive drum 7*a*. By this, the developing roller 200 is enabled to develop the electrostatic latent image on the drum.

In this manner, by the rotating operation of the rotary member 100, the contacting and the spacing between the developing roller 200 and the photosensitive drum 7*a*, and the switching of the developing cartridge B, are carried out.

Here, the rotational axis L4 of the driving shaft 14, the rotational axis L5 of the rotary member 100 and the rotational axis L6 of the rotary member shaft 101 are parallel with each other.

(7) Operations of the Inclination Regulating Member of the Developing Cartridge and Inclining Member Actuator of the Rotary Member Supporting Member:

Referring to FIGS. 19, 20, 21, 23, the description will be made as to the operation of the inclination regulating member of the developing cartridge and the operation of the inclining member actuator of the supporting member supporting the rotary member.

Figure 20:
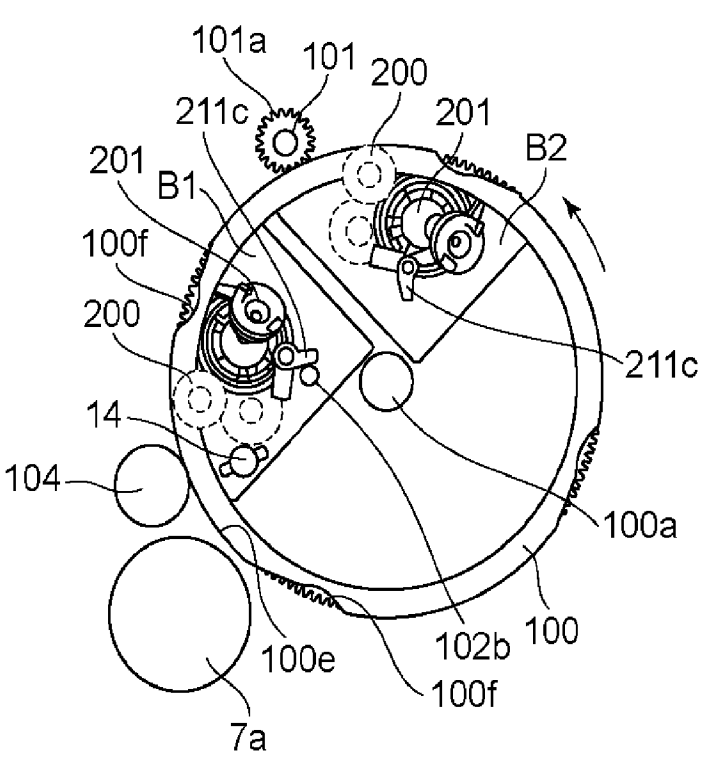
FIG. 20 is an illustration of the operation of the inclination regulating member of the developing cartridge and the inclining member actuator of the rotary member supporting member, in the first embodiment.
Figure 20:
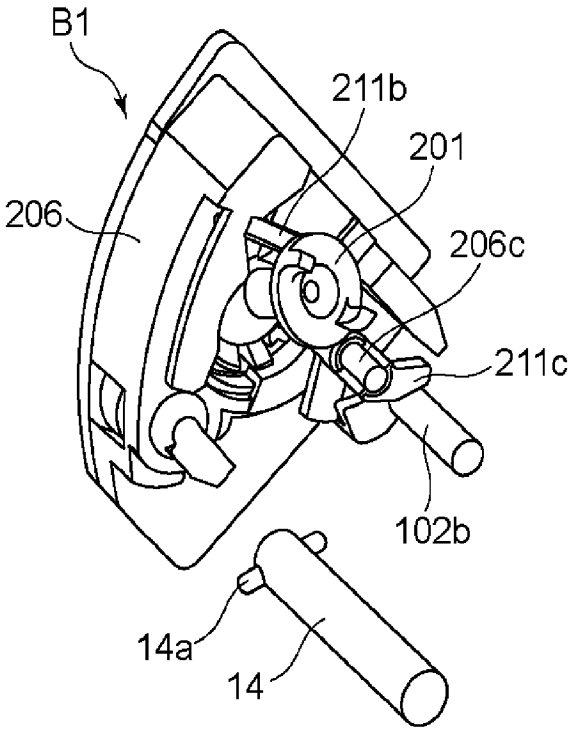
Figure 21:
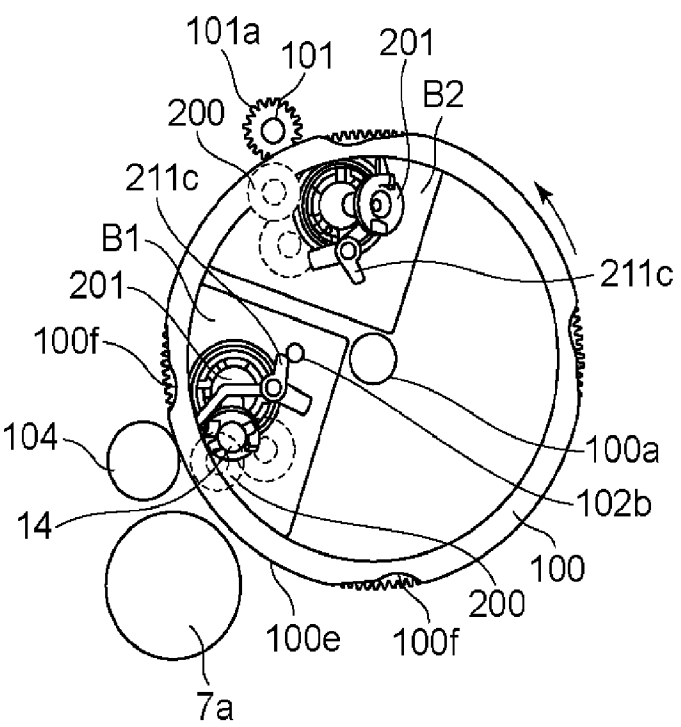
FIG. 21 is an illustration of the operation of the inclination regulating member of the developing cartridge and the inclining member actuator of the rotary supporting member, in the first embodiment.
Figure 21:
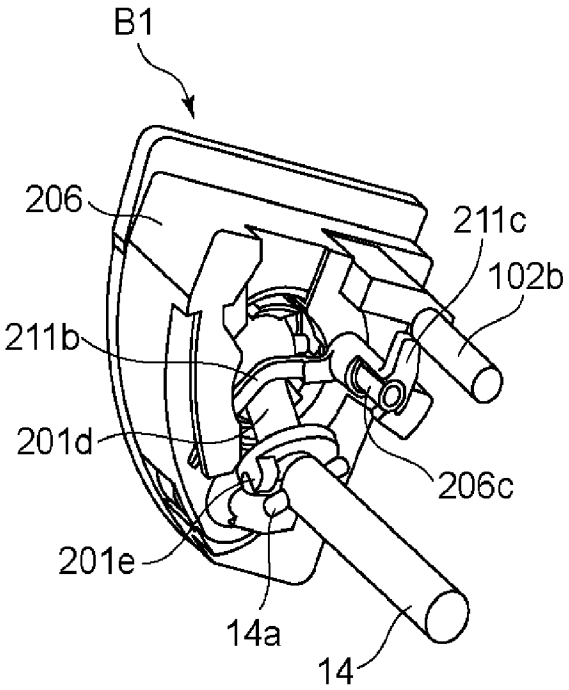
Figure 22:
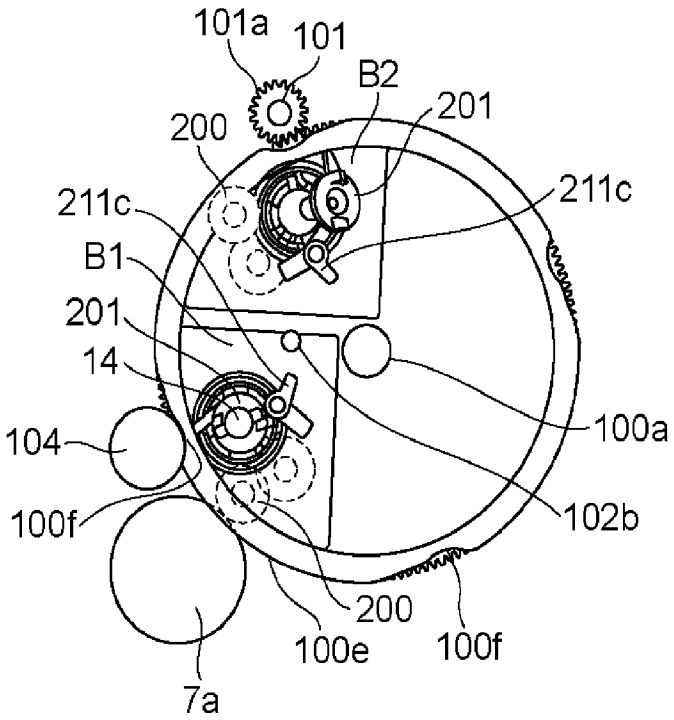
FIG. 22 is an illustration of the operation of the inclination regulating member of the developing cartridge and the inclining member actuator of the rotary member supporting member, in the first embodiment.
Figure 22:
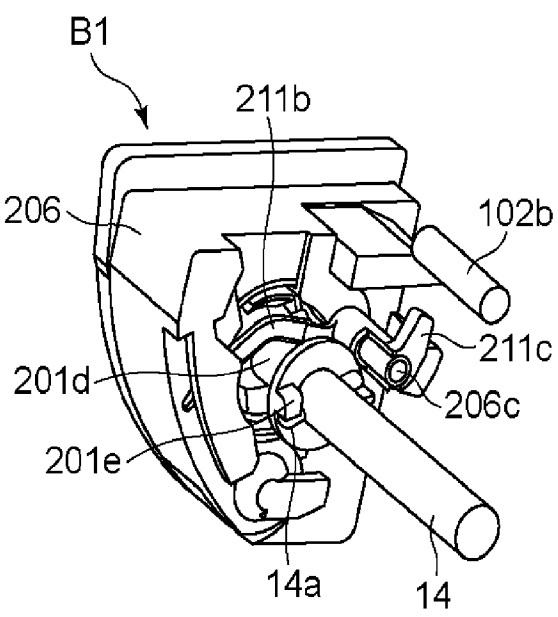

FIGS. 19, 20, 21 and 22 are illustrations of the operations of the inclination regulating member of the developing cartridge and inclining member actuator of rotary member supporting member. Part (a) of FIG. 19, part (a) of FIG. 20, part (a) of FIG. 21 and part (a) of FIG. 22 are perspective views of the coupling of the developing cartridge as seen from the driving shaft side; part (b) of FIG. 19, part (a) of FIG. 20, part (a) of FIG. 21 and part (a) of FIG. 22 are side views of the rotary member structure to which the developing cartridge is mounted, as seen from the driving shaft side.

For easy understanding of the operations, in FIGS. 19, 20, 21 and 22, only the developing cartridges B1 and B2 are shown. As for the supporting member 102, only the inclining member actuator 102*b* is shown.

The developing cartridge B1 mounted to the rotary member 100 shown in FIG. 19 is in the position 90° before the position where the developing roller 200 contacts the photosensitive drum 7*a*, and rotates in the direction substantially perpendicular to the rotational axis direction L4 of the driving shaft 14 in accordance with the rotation of the rotary member 100 in the counter-clockwise direction by the rotation of the rotary member shaft 101.

In the rotational position of the rotary member, the inclining member 211*c* of the coupling 201 of the developing cartridge B1 and the inclining member actuator 102*b* are spaced from each other. Therefore, inclination regulating member 211 does not incline the coupling 201 so that the rotational axis L3 of the coupling 210 can freely incline relative to the rotational axis L2 of the drive input gear 210 within the engagement range of the regulation pin 201 *g* in the regulation accommodating portion 209*a* as has been described in conjunction with FIG. 8 and FIG. 9.

The developing cartridge B1 shown in FIG. 20 is in the position where the rotary member 100 has rotated from the position of FIG. 19 while the cam surface 100*e* of the rotary member 100 is in contact to the roller 104, and the developing roller 200 is in the position 45° before the contact position where the developing roller 200 contacts the photosensitive drum 7*a*. The inclining member 211*c* of the coupling 201 of the developing cartridge B1 in this position of the rotary member is positioned so that the contact of the inclining member 211*c* to the inclining member actuator 102*b* of the supporting member 102 starts.

The developing cartridge B1 shown in FIG. 21 is in the position 19° before the contact position. In the rotation from the 45° position to the 19° position, the inclining member 211*c* of the coupling 201 of the developing cartridge B1 rotates about the rotation supporting shaft 206 while contacting the inclining member actuator 102*b*, with the rotation of the rotary member 100. By this, the coupling contact portion 211*b* of the inclination regulating member rotates while contacting to the connecting portion 201*d* of the coupling.

In this manner, during the inclining member 211*c* being in contact with the inclining member actuator 102*b*, the inclination regulating member 211 operates to incline the rotational axis L3 of the coupling 210 relative to the rotational axis L2 of the drive input gear 210. In other words, the inclination regulating member 211 moves to the regulating position.

In FIG. 21, the coupling contact portion 211*b* of the inclination regulating member limits the position of the coupling 210 with the maximum inclination of coupling 210. The inclination position of the coupling 210 at this time is the above-described pre-engagement angular position for the coupling 210 to engage with the driving shaft 14 by revolving movement of the developing cartridge B1 in the direction substantially perpendicular to the rotational axis direction L4 of the driving shaft 14. In this manner, the inclining member 211*c* is tilted by being abutted by the inclining member actuator 102*b*, by which the coupling 210 is inclined, and with such a simple structure, the coupling 210 can be placed in the pre-engagement angular position assuredly.

In the position of the developing cartridge B1 shown in FIG. 22, the roller 104 is in the surface recess 100*f* of the rotary member 100, in which the developing roller 200 is in contact with the photosensitive drum 7*a*.

In the rotation of the rotary member 100 from the 19° position of FIG. 21 to the position where the developing roller 200 contacts the photosensitive drum 7*a*, the driving shaft receiving surface 201*f* of the coupling 210 disposed in the pre-engagement angular position contacts the free end portion 14*b* of the driving shaft 14. With the rotations of the rotation shaft 14 and the rotary member 100, the projection 201*e* of the coupling and the pin portion 14*a* of the driving shaft are engaged with each other, so that the rotational force of the driving shaft 14 is transmitted to the coupling 210.

When the rotational force of the driving shaft 14 starts to transmit to the coupling 210, the inclining member 211*c* becomes away from the inclining member actuator 102*b* and is spaced therefrom with the rotation of the rotary member 100. In other words, the inclination regulating member 211 moves to the retracted position from the regulating position.

Then, in the coupling 210, the conical recessed portion of the driving shaft receiving surface 201*f* and the spherical portion of the free end portion 14*b* of the driving shaft 14 are faced to each other while contacting to each other. Therefore, the coupling is placed in a rotational force transmitting angular position in which the rotational axis L3 of the coupling and the rotational axis L4 of the driving shaft are substantially co-axial with each other. By doing so, the coupling 210 and the driving shaft 14 are aligned so that the rotational torque is transmitted to the coupling 210 stably.

In this manner, the coupling 210 of the developing cartridge B1 revolves in the direction substantially perpendicular to the rotational axis direction L4 of the driving shaft 14 so as to receive the rotational force from the driving shaft 14.

At the time when the coupling 210 is positioned in the rotational force transmitting angular position, the inclining member 211*c* is completely space from the inclining member actuator 102*b* by the rotation of the rotary member 100. Therefore, the coupling contact portion 211*b* no longer inclines the coupling 210, and the inclination regulating member 211 contact the connecting portion 201*d* of the coupling by the weight thereof.

Figure 23:
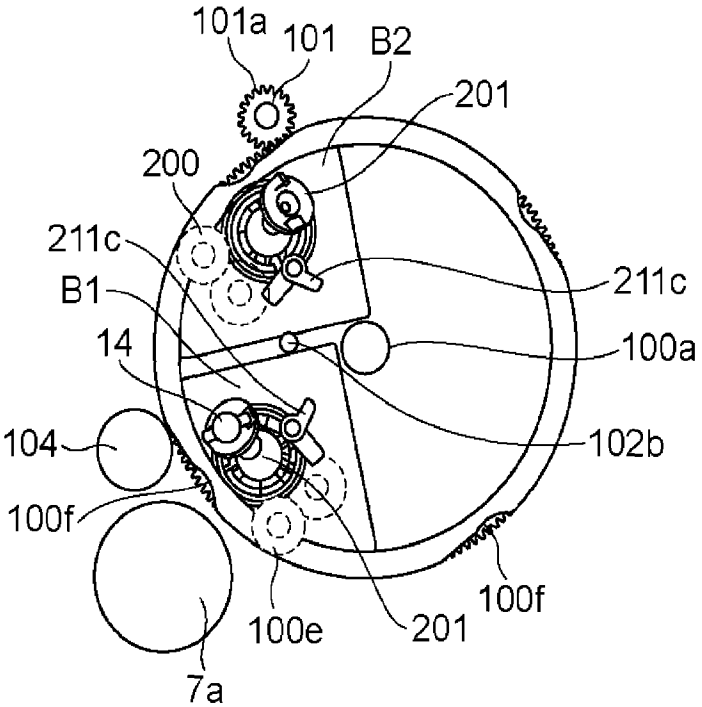
FIG. 23 is an illustration of the operation of the inclination regulating member of the developing cartridge and the inclining member actuator of the rotary member supporting member, in the first embodiment.
Figure 23:
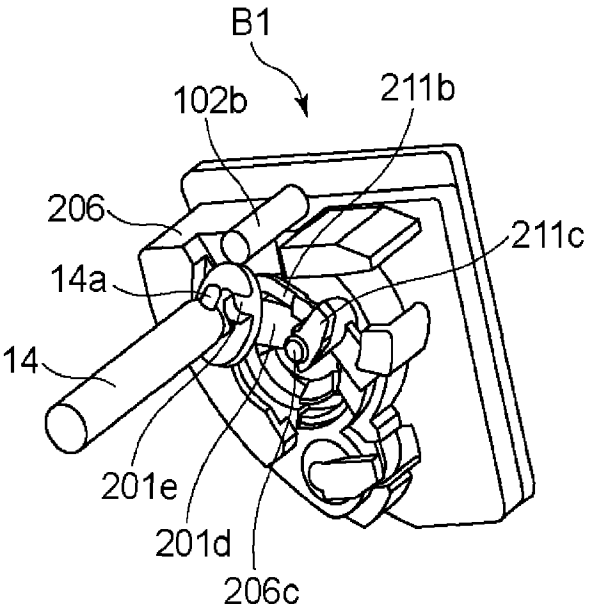

In the state shown in FIG. 23, taken after rotation of the rotary member 100 from the position shown in FIG. 22, the cam surface 100*e* contacts the roller 104 so that the developing roller 200 is spaced from the photosensitive drum 7*a*.

With the rotation of the rotary member 100, while the driving shaft receiving surface 201*f* of the coupling 210 and the free end portion 14*b* of the driving shaft 14 are in contact with each other, the coupling 210 inclines from the rotational force transmitting angular position. While inclining, the coupling 210 moves to a disengaging angular position where the projection 201*e* of the coupling is disengaged from the pin portion 14*a* of the driving shaft. That is, with the rotation of the rotary member 100, the coupling 210 becomes movable from the rotational force transmitting angular position to the disengaging angular position wherein the coupling 210 it is engageable from the driving shaft 14.

In this manner, the coupling 210 of the developing cartridge B1 is disengaged from the driving shaft 14 by the revolution in the direction substantially perpendicular to the rotational axis direction L4 of the driving shaft 14, so that the rotational force is not transmitted.

In the process of the coupling 210 moves from the rotational force transmitting angular position to the disengaging angular position, the inclining member 211*c* is completely spaced from the inclining member actuator 102*b*, and therefore, the coupling contact portion 211*b* does not regulate the position.

The rotational axis L3 of the coupling 210 in the disengaging angular position is substantially opposite from the pre-engagement angular position with respect to the rotational axis L2 of the drive input gear.

With further rotation of the rotary member 100 from the position of FIG. 23, the coupling 210 is disengaging from the driving shaft 14 without being limited by the inclination regulating member 211. Therefore, during the rotation of the rotary member 100 from the disengaging angular position to the position where the inclining member 211*c* shown in FIG. 20 starts to contact to the inclining member actuator 102*b* of the supporting member 102, the rotational axis L3 of the coupling 210 can inclination freely relative to the rotational axis L2 of the drive input gear 210.

After the coupling 210 is disengaged from the driving shaft 14, there is no means to regulate the position of the coupling 210, and therefore, the coupling 210 do not change the position abruptly, so that the hitting noise can be reduced.

In this manner, by the rotation of the rotary member 100, the developing cartridge B can be switched, and simultaneously, the coupling 210 and the driving shaft 14 can be engaged with each other and can be disengaged from each other in the direction substantially perpendicular to the axial direction of the driving shaft.

As described above, the coupling 210 can be placed assuredly to the pre-engagement angular position before the engagement between the coupling 210 and the driving shaft 14 with a simple structure without using urging means (elastic member) such as coil spring or the like. In addition, it is not necessary to place the coupling 210 to the pre-engagement angular position using such urging means (elastic member), and therefore, the coupling 210 does not return from the disengaging angular position to the pre-engagement angular position abruptly, so that a hitting noise can be avoided.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 127145/2012 filed Jun. 4, 2012, which is hereby incorporated by reference.

What is claimed is:

1. A developing cartridge comprising:

a casing including a shaft;

a developing roller provided in the casing, the developing roller being configured to rotate and carry developer;

a coupling member configured to receive a rotational force for rotating the developing roller, the coupling member being movable between a first position in which a rotational axis of the coupling member is parallel to a rotational axis of the developing roller and a second position in which the rotational axis of the coupling member is inclined relative to the rotational axis of the developing roller; and a rotatable lever rotatable with respect to the casing and the shaft, the rotatable lever being provided adjacent to the coupling member, the rotatable lever including (i) a contact portion contactable to the coupling member and (ii) a bearing portion including a hole into which the shaft is inserted, with the bearing portion being rotatably supported by the shaft, the rotatable lever being rotatable between a contact position in which the contact portion contacts the coupling member and a spaced position in which the contact portion is spaced from the coupling member, wherein the contact portion is capable of moving the coupling member from the first position to the second position by a rotation of the rotatable lever.

2. A developer cartridge according to claim 1, wherein the rotatable lever is made of resin.

3. A developing cartridge according to claim 1, wherein a rotational axis of the rotatable lever is parallel to the rotational axis of the developing roller.

4. A developer cartridge according to claim 1, wherein the rotatable lever includes an exposed portion that is exposed as seen in a direction perpendicular to the rotational axis of the developing roller and rotatable integrally with the contact portion.

5. A developer cartridge according to claim 4, wherein the exposed portion is disposed at a more outward position than at least a part of the casing with respect to a direction of the rotational axis of the developing roller.

6. A developing cartridge according to claim 1, wherein the exposed portion and the contact portion are disposed at different positions with respect to a rotational direction of the rotatable lever.

7. A developer cartridge according to claim 1, wherein a rotational axis of the rotatable lever is not coaxial with the rotational axis of the coupling member in the first position.

8. A developer cartridge according to claim 1, wherein the casing includes a frame and a cover attached to an end portion of the frame in the direction of the rotational axis of the developing roller.

* * * * *